US007602367B2

(12) United States Patent
Kawaguchi

(10) Patent No.: US 7,602,367 B2
(45) Date of Patent: Oct. 13, 2009

(54) FLAT DISPLAY PANEL DRIVING METHOD AND FLAT DISPLAY DEVICE

(75) Inventor: Seiji Kawaguchi, Hirakata (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 512 days.

(21) Appl. No.: 11/144,668

(22) Filed: Jun. 6, 2005

(65) Prior Publication Data

US 2005/0270282 A1 Dec. 8, 2005

(30) Foreign Application Priority Data

Jun. 7, 2004 (JP) ..... 2004-168589

(51) Int. Cl.
*G09G 3/36* (2006.01)
*G09G 5/10* (2006.01)

(52) U.S. Cl. ..... 345/100; 345/690

(58) Field of Classification Search ..... 345/690, 345/698, 100

See application file for complete search history.

(56) References Cited

U.S. PATENT DOCUMENTS

| | | | | |
|---|---|---|---|---|
| 5,796,381 | A * | 8/1998 | Iwasaki et al. | 345/101 |
| 6,633,283 | B2 * | 10/2003 | Fukuda et al. | 345/204 |
| 7,352,350 | B2 * | 4/2008 | Nitta et al. | 345/94 |
| 2004/0150605 | A1 * | 8/2004 | Arimoto et al. | 345/100 |

FOREIGN PATENT DOCUMENTS

| | | |
|---|---|---|
| CN | 1498356 A | 5/2004 |
| JP | 11-109921 | 4/1999 |
| JP | 2003-215542 | 7/2003 |
| TW | 571284 | 1/2004 |
| TW | 577040 | 2/2004 |
| WO | WO 03/036379 A1 | 5/2003 |

OTHER PUBLICATIONS

U.S. Appl. No. 11/172,835, filed Jul. 5, 2005, Kawaguchi.

* cited by examiner

*Primary Examiner*—Amr Awad
*Assistant Examiner*—Randal Willis
(74) *Attorney, Agent, or Firm*—Oblon, Spivak, McClelland, Maier & Neustadt, L.L.P.

(57) ABSTRACT

A flat display panel comprises a matrix array of pixels that displays an image, a controller that receives a video signal supplied externally along with a horizontal sync signal defining a horizontal scanning period and a vertical sync signal defining a vertical scanning period, a driver circuit that is controlled by the controller and writes the video signal and non-video signal into each row of pixels in each vertical scanning period, and an insertion timing setting section that controls a write timing of the non-video signal to synchronize with a write timing of the video signal. The insertion timing setting section is configured to count the number of horizontal sync signals supplied within the vertical scanning period defined by each vertical sync signal, and then determine the write timing of the non-video signal based on a result of counting.

7 Claims, 9 Drawing Sheets

FIG. 9

(a)

| X1 (TFT-1) | X2 (TFT-2) | X1 (TFT-3) | X2 (TFT-4) | X3 (TFT-5) | X4 (TFT-6) |
|---|---|---|---|---|---|
| + | − | + | − | + | − |
| − | + | − | + | − | + |
| + | − | + | − | + | − |
| − | + | − | + | − | + |
| + | − | + | − | + | − |
| − | + | − | + | − | + |

(b)

| X1 (TFT-1) | X2 (TFT-2) | X1 (TFT-3) | X2 (TFT-4) | X3 (TFT-5) | X4 (TFT-6) |
|---|---|---|---|---|---|
| − | + | − | + | − | + |
| + | − | + | − | + | − |
| − | + | − | + | − | + |
| + | − | + | − | + | − |
| − | + | − | + | − | + |
| + | − | + | − | + | − |

FLAT DISPLAY PANEL DRIVING METHOD AND FLAT DISPLAY DEVICE

CROSS-REFERENCE TO RELATED APPLICATIONS

This application is based upon and claims the benefit of priority from prior Japanese Patent Application No. 2004-168589, filed Jun. 7, 2004, the entire contents of which are incorporated herein by reference.

BACKGROUND OF THE INVENTION

1. Field of the Invention

The present invention relates to a flat display panel driving method and a flat display device, and more particularly, to a method of driving a flat display panel such as an OCB-type liquid crystal display panel capable of providing a wide viewing angle and high-speed response, and a flat display device.

2. Description of the Related Art

Currently, a liquid crystal display panel utilizing characteristics such as lightness, thinness, and low power consumption is used as a display for use in television sets, personal computers and car navigation systems.

A twisted nematic (TN) type liquid crystal display panel widely utilized as this liquid crystal display panel is configured such that a liquid crystal material having optically positive refractive anisotropy is set to a twisted alignment of substantially 90° between glass substrates opposed to each other, and optical rotary power of incident light is adjusted by control-ling its twisted alignment. Although this TN-type liquid crystal display panel can be comparatively easily manufactured, its viewing angle is narrow, and its response speed is low. Thus, this panel has been unsuitable to display a moving image such as a television image, in particular.

On the other hand, an optically compensated birefringence (OCB) type liquid crystal display panel attracts attention as a liquid crystal display panel which improves a viewing angle and a response speed. The OCB-type liquid crystal display panel is sealed with a liquid crystal material capable of providing a bend alignment between the opposed glass substrates. The response speed is improved by one digit as compared with the TN-type liquid crystal display panel. Further, there is an advantage that the viewing angle is wide because optically self compensation is made from an alignment state of the liquid crystal material.

In the OCB-type liquid crystal display panel, as shown in (a) of FIG. 7, liquid crystal molecules 65 of a liquid crystal layer are set to a splay alignment when no voltage is applied between a pixel electrode 62 disposed on a glass based array substrate 61 and an counter electrode 64 disposed similarly on a glass based counter substrate 63 which is opposed to the array substrate 61. Thus, when a high voltage of the order of some tens of voltages is applied between the pixel electrode 62 and the counter electrode 64 upon supply of power, the liquid crystal molecules 65 are transferred to the bend alignment.

To reliably transfer the alignment state upon high voltage application, voltages opposite in polarity are applied to adjacent horizontal lines of the pixels to create a nucleus by a laterally twisted potential difference between the adjacent pixel electrode 62 and transfer pixel electrode. The alignment state is transferred around the nucleus. Such an operation is carried out for substantially one second, whereby the splay alignment is transferred to the bend alignment. Further, a potential difference between the pixel electrode 62 and the counter electrode 64 is equalized, thereby temporarily eliminating an undesired record.

After the liquid crystal molecules 65 have been thus transferred to the bend alignment, a voltage exceeding a low OFF voltage, at which the liquid crystal molecules 65 are maintained in the bend alignment as shown in (b) of FIG. 7, is applied from a drive power supply 66 during operation. Not only the OFF voltage but also a ON voltage which is higher than the OFF voltage is applicable from the drive power supply 66 as shown in (c) of FIG. 7. Thus, the drive voltage between the electrodes 62 and 64 changes in the range of the OFF voltage to the ON voltage. Consequently, the alignment state of the liquid crystal molecules 65 is transferred between the bend alignment shown in (b) of FIG. 7 and the bend alignment shown in (c) of FIG. 7 to change a retardation value of the liquid crystal layer, thereby controlling transmittance.

In the case where an OCB-type liquid crystal display panel is used for displaying an image, birefringence is controlled in association with polarizing plates. The liquid crystal panel is driven by a driver circuit such that light is shielded (for a black display) upon application of a high voltage and is transmitted (for a white display) upon application of a low voltage, for example.

The driver circuit includes a scanning line driver circuit 67 which is formed integrally on the array substrate 61 as shown in FIG. 8 and from which a plurality of scanning lines Y1 to Yn extend in a row direction, and a signal line driver circuit (not shown) from which a plurality of signal lines X1 to Xm extend in a column direction to intersect the scanning lines Y1 to Yn.

The signal lines X1 to Xm are divided into odd numbered signal lines X1, X3, . . . and even numbered signal lines X2, X4, . . . , and drain-source paths of thin film transistors (TFTs) 68-1, 68-2, . . . **68-*m*' (m'=2m) configured as a pair of selector switches on an even number and odd number basis are connected to the respective signal lines X1 to Xm in parallel with each other. Among them, gates of TFTs 68-1, 68-3, . . . of an odd numbered set is connected to a terminal 69 to which a first selection signal is supplied, and gates of TFTs 68-2, 68-4, . . . of an even numbered set is connected to a terminal 70 to which a second selection signal is supplied, so that a video signal supplied to each of terminals 71, 72** is selected by the corresponding selection signal.

Switching thin film transistors (TFTs) 73 are disposed at intersections between the scanning lines Y and the signal lines X in which the drain-source paths of the TFTs 68-1 to **68-*m*' are inserted. Each TFT 73 has a gate connected to one of the scanning lines Y1 to Yn, and a drain-source path connected at one end to one of the signal lines X. The other end of the drain-source path of the TFT 73 is connected to a liquid crystal capacitance element 74, and is connected to one end of a storage capacitance element 75. The other end of the storage capacitance element 75 is connected to a terminal 76 via a capacitance line Cs, and a storage capacitance voltage is applied from the terminal 76**.

In addition, a vertical scanning clock signal and a vertical start signal are supplied to the scanning line driver circuit 67 via a terminal 77 and a terminal 78, respectively.

With such a configuration, a gate pulse from the scanning line driver circuit 67 is sequentially supplied to the scanning lines Y1 to Yn by line-at-a-time driving method, and TFTs 73 on one scanning line X are turned on simultaneously. In synchronism with this scanning, video signals from the signal line driver circuit are supplied via the terminals 71, 72 and the TFTs 68-1 to **68-*m*' to the TFTs 73, to store a signal charge in each liquid crystal capacitance element 74 and the corresponding storage capacitance element 75 through the drain-source path of the corresponding TFT 73. The signal charge is held until a next scanning period has been established. Consequently, the liquid crystal capacitance elements 74 of all pixels connected to the scanning lines X are activated to display an image, the storage capacitance elements 75 are driven by a storage capacitance voltage which is applied by grounding the terminal 76 or by supplying a gate pulse in a reverse phase and supplied to the terminal 76**.

In such a liquid crystal display panel, for example, in a first half of one horizontal scanning period (1H), a signal voltage having positive polarity (+) with respect to a voltage of the counter electrode 64 is written into the pixel electrode 62 connected via the TFT 68-1 for the signal line X1, and a signal voltage having negative polarity (−) with respect to a voltage of the counter electrode 64 is written into the pixel electrode 62 connected to the TFT 68-4 for the signal X2, respectively, as shown in (a) of FIG. 9.

In a latter half of 1H, a signal voltage having negative polarity (−) with respect to a voltage of the counter electrode 64 is written into the pixel electrode 62 connected via the TFT 68-2 for the signal line X2, a signal voltage having positive polarity (+) with respect to a voltage of the counter electrode 64 is written into the pixel electrode 62 connected via the TFT 68-3 for the signal line X1.

In addition, in a next frame, in a first half of 1H, a signal voltage having negative polarity (−) with is respect to a voltage of the counter electrode 64 is written into the pixel electrode 62 connected to via the TFT 68-1 for the signal line X1, and a signal voltage having positive polarity (+) with respect to a voltage of the counter electrode 64 is written into the pixel electrode 62 connected via the TFT 68-4 for the signal line X2, respectively, as shown in (b) of FIG. 9.

In a latter half of 1H, a signal voltage having positive polarity (+) with respect to a voltage of the counter electrode 64 is written into the pixel electrode 62 connected via the TFT 68-2 for the signal X2, and a signal voltage having negative polarity (−) with respect to a voltage of the counter electrode 64 is written into the pixel electrode 62 connected via the TFT 68-3 for the signal line X1. In this manner, frame inversion driving and dot inversion driving are carried out, thereby preventing an application of an undesired direct current voltage and preventing an occurrence of flickering.

In such an OCB-type liquid crystal display panel, the alignment state can be transferred from the spray alignment to the bend alignment by means of a voltage applied between the pixel electrode 62 and the counter electrode 64. However, even if the bend alignment has been established, so-called inverse transfer from the bend alignment to the splay alignment easily occurs if the voltage held between the pixel electrode 62 and the counter electrode 64 is maintained at low voltage level. This raises a problem that a display image cannot be recognized.

As a countermeasure against the problem caused by the inverse transfer, it necessary that a high voltage is periodically applied (black-signal inserted) to a liquid crystal layer to prevent occurrence of the reversed transfer phenomenon. However, in the case where a black signal insertion process is performed to apply a high voltage, timing signals for inserting a black signal in an input signal are produced in a process on the television set side. Thus, there is a problem that an increased number of interfaces is required between the television set side and a liquid crystal panel module side.

Further, it is difficult to employ the countermeasure, because the processing capacity of a microcomputer is not enough to perform such a process on the television set side, and a design suitable to the television set side is required to be made on the liquid crystal panel side. Therefore, there is a problem that general use properties become poor.

In addition, in the case where the OCB-type liquid crystal display panel is used as a flat display device for use in a television set, this display panel is used under a condition in which the ambient temperature of the flat display device ranges from about 0 to 60° C. Further, in the case where the flat display device is used as a display for use in a car navigation system, the external environment of the television set used significantly changes. As a consequence, the ambient temperature of the flat display device is believed to significantly change from below 0° C. to about 80° C., and the use under a severer environment condition than that in room must be made. Therefore, it is necessary to set operating conditions of these flat display devices to a use condition adapted to the external environment.

FIG. 10 shows a result obtained by making an investigation about a temperature change which is one of the external environment changes.

FIG. 10 is a gamma characteristic view in which gradation is plotted on the horizontal axis and luminance is plotted on the vertical axis. In the figure, solid line "a" indicates a case in which the ambient temperature is 20° C.; dashed line "b" indicates a case in which the ambient temperature is 40° C.; single-dot chain line "c" indicates a case in which the ambient temperature is 60° C.; and double dot chain line "d" indicates a case in which the ambient temperature is 80° C. Here, when the ambient temperature is 80° C., a black inversion region is within the range indicated by the arrow "e" shown in the figure. This range serves as a region in which a problem occurs with a display quality.

In order to ensure that a problem does not occur with the display quality at this high temperature, it is necessary to set a black display voltage to be lower at the time of the high temperature. However, because it is difficult to change this setting once it has been set, the setting of the black display voltage at the time of the high temperature is kept unchanged even at the time of a room temperature of 20° C. Accordingly, the black luminance at the time of room temperature has increased from 1.1 to 2.6 cd/m$^2$. Thus, the contrast is lowered from 450:1 to 170:1, and as a result, there occurs a problem that a sharp and clear image having its good contrast cannot be produced.

In addition, in the flat display device using the OCB-type liquid crystal display panel, black (black signal) insertion is carried out in order to prevent an inverse transfer phenomenon. However, an increased black insertion ratio is required to prevent the reversed transfer phenomenon at the time of the high temperature.

That is, FIG. 11 is a black insertion ratio characteristic view in each ambient temperature at which ambient temperature is taken on a horizontal axis and a black insertion ratio is taken on a vertical axis. This figure shows that it is necessary to increase the black insertion ratio with an increase of the ambient temperature. Because this black insertion ratio is shown as a value including a margin, such tendency does not change although slight change occurs.

As described above, the black insertion ratio is increased to prevent inverse transfer at the time of a high temperature. As is the case with the black display voltage described previously, however, the black insertion ratio at the time of this high temperature is maintained as is even at the time of room temperature. Thus, there has occurred a problem that, when operation is made at the time of room temperature, the luminance is lowered from 500 cd/m$^2$ to 430 cd/m$^2$, and the contrast is also lowered from 450:1 to 170:1.

BRIEF SUMMARY OF THE INVENTION

The present invention has been made in order to solve the foregoing problem. It is an object of the present invention to provide a flat display panel driving method and flat display device which reliably prevent occurrence of inverse transfer without requiring an increase in the number of interfaces.

According to a first aspect of the present invention, there is provided a flat display panel driving method for driving a flat display panel which includes a matrix array of pixels to display an image, comprising the steps of: receiving a video signal supplied externally along with a horizontal sync signal defining a horizontal scanning period and a vertical sync signal defining a vertical scanning period; writing the video signal and a non-video signal into each row of pixels in each vertical scanning period; and controlling a write timing of the non-video signal to synchronize with a write timing of the video signal; wherein the control step includes counting the number of horizontal sync signals supplied within the vertical scanning period defined by each vertical sync signal, and determining the write timing of the non-video signal based on a result of counting.

According to a second aspect of the present invention, there is provided a flat display panel driving method, wherein the result of counting is an average value of the numbers of horizontal sync signals obtained for a predetermined number of vertical scanning periods in a case where the number of horizontal sync signals is variable.

According to a third aspect of the present invention, there is provided a flat display panel driving method, wherein the control step includes obtaining a video signal holding period which is represented by a formula: number of horizontal sync signals supplied within vertical scanning period×(100−non-video signal insertion ratio)/100, and then determining a timing that is delayed by the video signal holding period from the write timing of the video signal, as the write timing of the non-video signal.

According to a fourth aspect of the present invention, there is provided a flat display panel driving method, wherein the control step includes measuring a temperature of the flat display panel or ambient temperature of the flat display panel, and causing a result of measurement to be reflected in the write timing of the non-video signal.

According to a fifth aspect of the present invention, there is provided a flat display device, which comprises: a matrix array of pixels that displays an image; a controller that receives a video signal supplied externally along with a horizontal sync signal defining a horizontal scanning period and a vertical sync signal defining a vertical scanning period; a driver circuit that is controlled by the controller and writes the video signal and a non-video signal into each row of pixels in each vertical scanning period; and an insertion timing setting section that controls a write timing of the non-video signal to synchronize with a write timing of the video signal; wherein the insertion timing setting section is configured to count the number of horizontal sync signals supplied within the vertical scanning period defined by each vertical sync signal, and then determine the write timing of the non-video signal based on a result of counting.

With the flat display panel driving method and flat display device described above, the write timing of the non-video signal is determined based on a result of counting the number of horizontal sync signals supplied within the vertical scanning period defined by each vertical sync signal. Accordingly, it becomes possible not only to control an insertion ratio of the non-video signal without any restriction imposed on interfaces or the like with a television set side, but also to reliably prevent an inverse transfer phenomenon while improving general use properties.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 9 is a diagram for explaining a driving method for driving the liquid crystal display panel shown in FIG. 8;

DETAILED DESCRIPTION OF THE INVENTION

Hereinafter, a flat display device according to one embodiment of the present invention will be described in detail with reference to the accompanying drawings.

Figure 1:
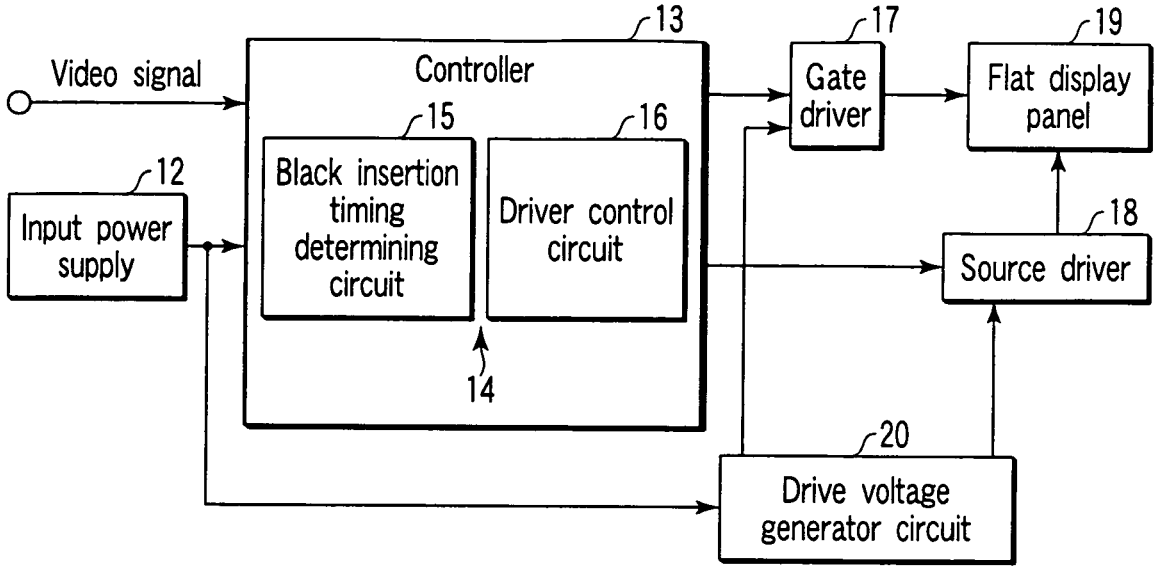
FIG. 1 is a diagram showing the circuit configuration of a flat display device according to one embodiment of the present invention.

In the flat display device, as shown in FIG. 1, input signals such as a vertical sync signal, a horizontal sync signal and a video signal are input from an input terminal 11, and these input signals are supplied to a controller 13 energized by an input power supply 12. The controller 13 incorporates a black signal insertion timing setting section 14. The black signal insertion timing setting section 14 is composed of a black signal insertion timing determination circuit 15 and a driver control circuit 16, and is configured to produce a timing pulse for inserting a black signal by means of the driver control circuit 16 based on a condition set by the black signal insertion timing setting section 14.

In the OCB mode, continuous application of a low voltage allows the alignment state of liquid crystal molecules to be inverse-transferred from the bend alignment to the splay alignment. The black signal is a signal for preventing the inverse transfer phenomenon, and used as an example of the non-video signal in this embodiment. A write operation for the black signal is called black insertion, and the black signal is inserted at a desired black insertion ratio for each field. The black insertion ratio is controlled as a time difference between the write timing for writing the video signal into a row (line) of the pixels and the write timing for writing the black signal into these pixels.

The controller 13 supplies drive signals to a gate driver 17 and a source driver 18, respectively. With the drive signals, the gate driver 17 and source driver 18 supply a gate pulse and a video signal to a flat display panel 19 such as an OCB-type liquid crystal display panel, respectively. To operate the gate driver 17 and the source driver 18, a drive voltage is also supplied from a drive voltage generator circuit 20, which is connected to the input power supply 12. The drive voltage, gate pulse, the video signal, etc. are associated with each other to display an image on the flat display panel 19.

The black signal insertion timing setting section 14 is used to obtain a write timing of a black signal to be inserted in the period of one field, so that occurrence of the inverse transfer phenomenon can be prevented effectively. The timing for this black signal insertion is set as follows.

Figure 2:
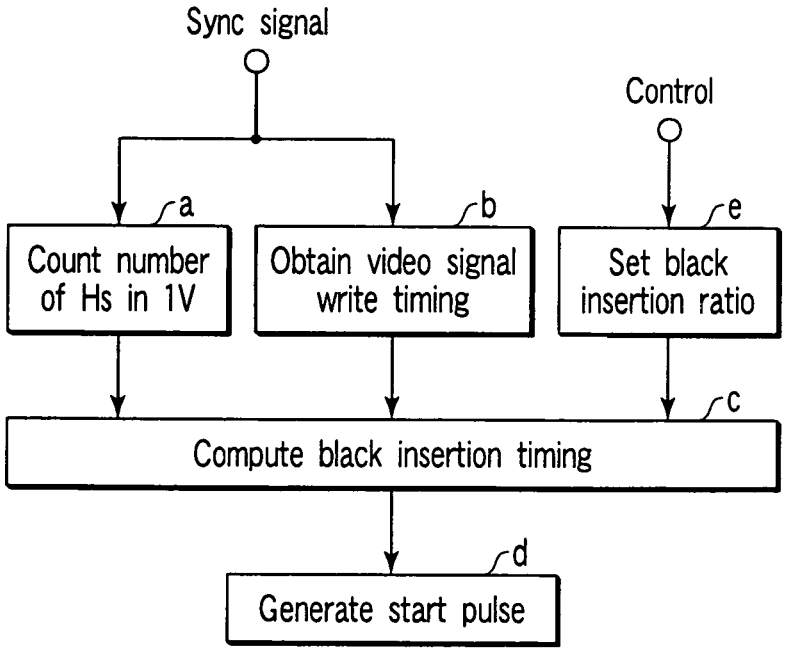
FIG. 2 is a chart for explaining a driving method for driving a flat display panel incorporated in the flat display device shown in FIG. 1.

That is, as shown in FIG. 2, the input sync signals such as a horizontal sync signal H, a vertical sync signal VD, and a gating signal DE, etc are subjected to processing. First, counting of the horizontal sync signal H is carried out within one vertical scanning period V (=1 field) to determine the number of Hs in 1V ("a" in the figure).

At the same time, a write timing of the video signal is obtained from these sync signals ("b" in the figure).

The number of Hs is used to obtain a black signal insertion timing synchronized with the video signal write timing. The black signal insertion timing is set to a timing which is delayed from the video signal write timing by a period represented by a formula: number of Hs in 1V×(100−black insertion ratio)/100 ("c" in the figure), and a gate start pulse is produced ("d" in the figure) based on the thus set timing.

Alternatively, the black insertion ratio may be externally set ("e" in the figure) and used to compute the black signal insertion timing.

With the computational formula, it becomes possible write the black signal with a predetermined delay corresponding to the number of Hs after the video signal write timing.

A description will be specifically given in more detail. The vertical sync signal VD defines 1V shown in (a) of FIG. 3. In 1V, a plurality of horizontal sync signals H are present as shown in (b) of FIG. 3. Counting of the horizontal sync signal H is effected by a counter that operates in response to a fall of the vertical sync signal VD. The number of Hs is counted in 1V which is a period between points indicated by arrows. As a result, it is measured that the number of Hs in 1V is, for example, 50, as shown in (d) of FIG. 3.

Figure 3:
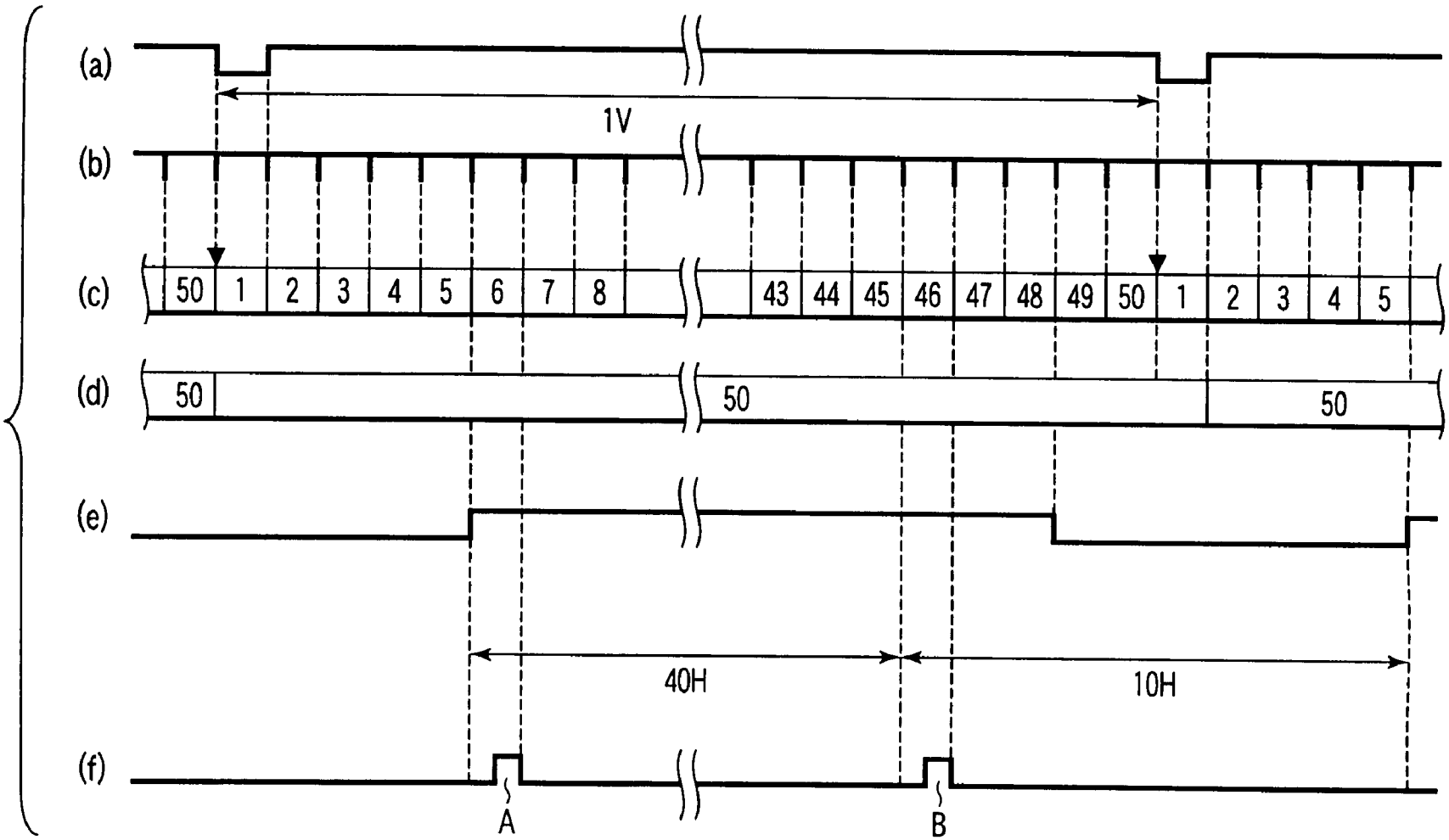
FIG. 3 is a signal waveform chart for explaining the diving method shown in FIG. 2.

In addition, as shown in (e) of FIG. 3, a display period defined by a display pulse is set at a period ranging from 6H to 48H. In this condition, the black insertion ratio can be set to a predetermined value. Assuming that the black insertion ratio is set to 20% as illustrated, computation is made using the ratio in the computational formula for the black signal write timing described previously. Assuming that the display pulse is supplied at a timing of the 6th H, the black insertion ratio 20% can be achieved by generating a start pulse A for video signal writing at the same timing of the 6th H and a start pulse B for black signal writing at a timing of the 46th H, which is delayed by 40 Hs from generation of the start pulse A.

In this manner, the write timing of the black signal is optimized to obtain a required black insertion ratio. Thus, it is efficiently and reliably prevent an inverse transfer phenomenon.

This black insertion is carried out for each 1V, and a black signal write timing for black signal insertion can be freely set by changing the black insertion ratio.

In a television signal for a television broadcast or the like, an identical number of Hs is obtained for each 1V. Therefore, the black insertion ratio is in a stable state. The foregoing description has been given with respect to a case of the black insertion ratio in such a stable state. However, for example, in a videotape recorder that uses a video tape as a recording medium and has a special reproduction function such as fast feed or slow reproduction, there is a case where the number of Hs reproduced in 1V is variable. In this case, the black insertion timing fluctuates according to the number of Hs in 1V. Consequently, it becomes into a situation where the black insertion ratio is not kept constant.

Figure 4:
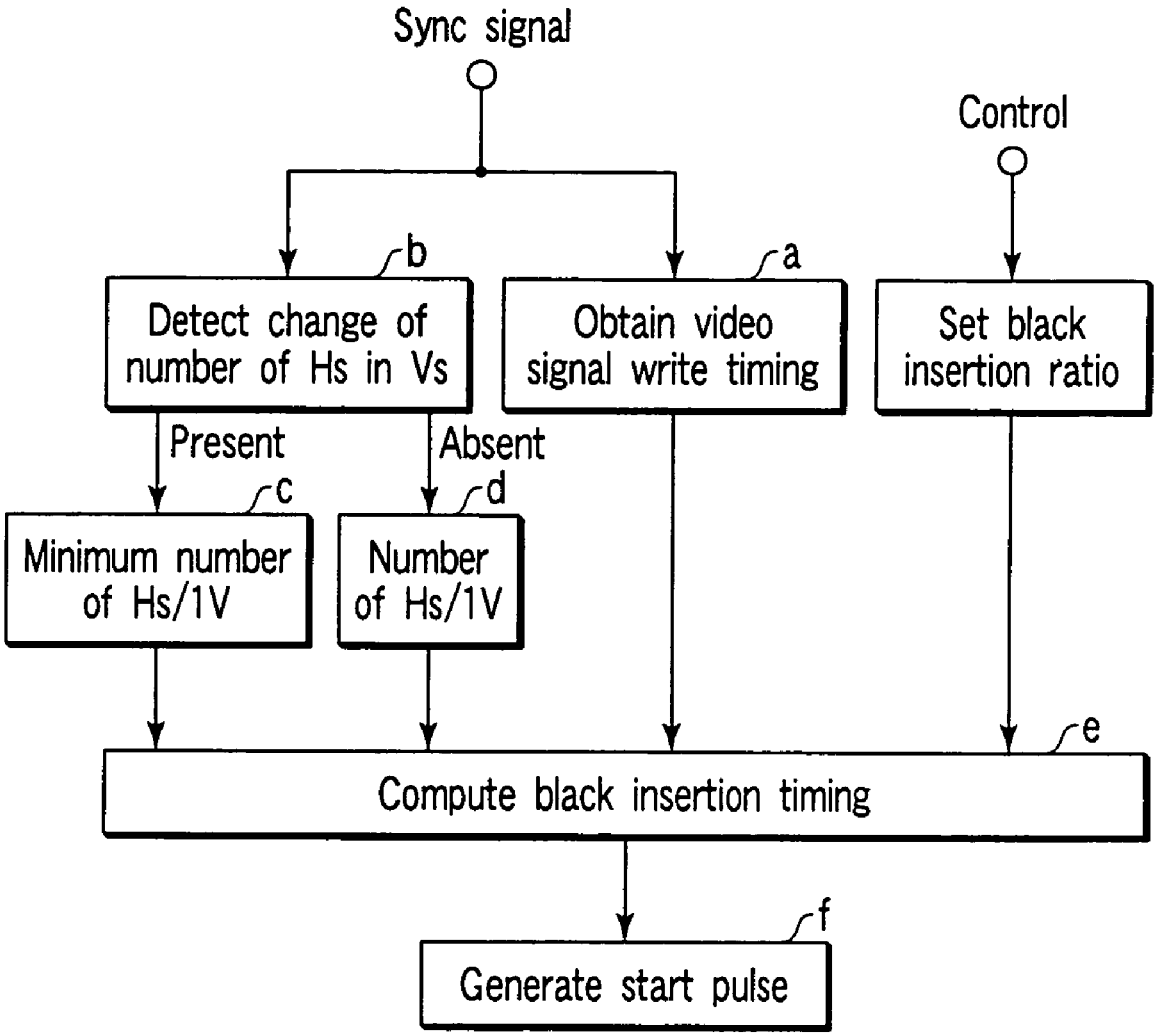
FIG. 4 is a chart for explaining a modification of the driving method shown in FIG. 2.

In such a case, as shown in FIG. 4, a write timing of the video signal is obtained from the input sync signals ((a) of FIG. 4), and the number of Hs for each 1V on at least of continuous 2Vs or more is counted, the numbers of Hs counted between 1Vs of these 2Vs, respectively, are compared with each other, and it is detected whether or not a change occurs with the numbers of Hs ((b) of FIG. 4). As a result, in the case where it has been determined that a change occurs with the number of Hs, the number of Hs in the fewest 1V is determined from among them ((c) of FIG. 4). In the case where it has been determined that no change occurs with the number of Hs in 1V, the counted number of Hs in 1V is determined ((d) of FIG. 4). Thus, the video signal write timing is determined based on the numbers of Hs included in the sync signals, and computation of a black signal insertion timing is made using the computational formula described previously ((e) of FIG. 4), and a gate start pulse for black signal insertion is generated ((f) of FIG. 4). A black signal insertion write timing is set in accordance with a video signal write timing by means of the start pulse. Consequently, even if a change occurs with the number of Hs in 1V, a black signal can be always inserted at an optimal position regardless of the change in number of Hs, making it possible to ensure a predetermined black insertion ratio.

Figure 5:
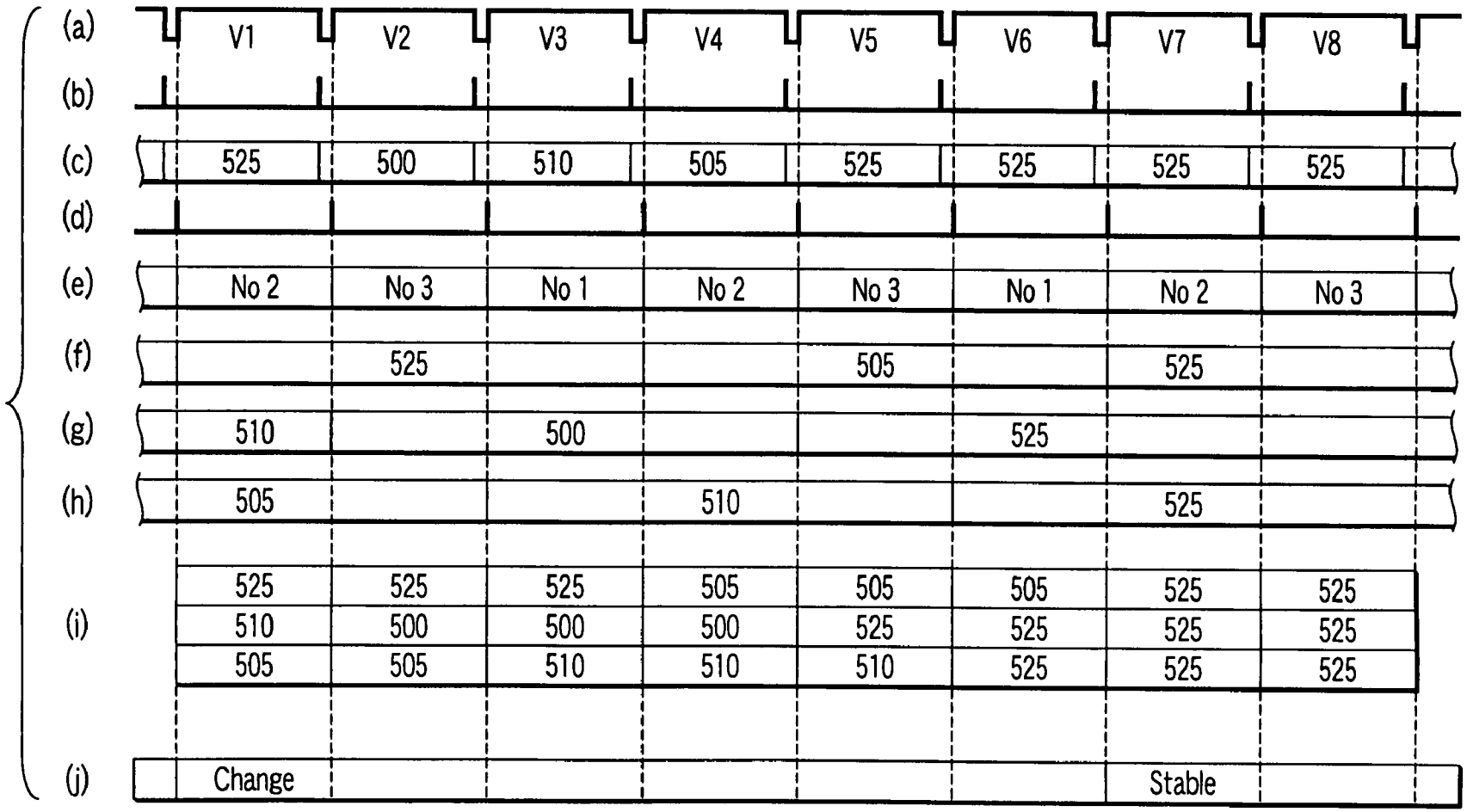
FIG. 5 is a signal waveform chart for explaining the modification shown in FIG. 4.

That is, assume that a write pulse shown in (b) of FIG. 5 is generated in synchronism with a fall of the vertical sync signal VD as shown in (a) of FIG. 5, and that the numbers of Hs obtained in the respective 1Vs in the video signals written by this write pulse are different from one another, that is, 525, 500, 510, 505, and 525, respectively, as shown in (c) of FIG. 5. These signals are read in synchronism with a read pulse as shown in (d) of FIG. 5. In this read, for example, in order to count and compare the numbers of Hs in 3Vs as shown in (e) of FIG. 5, each V is switched, read, and stored in accordance with the sequence of Nos. 1 to 3. Therefore, in a V1 period, the H number of 525Hs corresponding to No. 2 is stored over 3Vs as shown in (f) of FIG. 5. Similarly, in a V2 period, the H number of 500H corresponding to No. 3 is stored over 3Vs as shown in (g) of FIG. 5. In a V3 period, the H number of 510H corresponding to No. 1 is stored over 3Vs as shown in (h) of FIG. 5. In this way, the number of Hs for each 1V in 3Vs is stored, and the numbers are compared with each other in each 1V like the respective corresponding periods V1, V2, V3, . . . , as shown in (i) of FIG. 5, and it is determined whether or not a change occurs with the number of Hs for each 1V.

In the case where there is a difference in number of Hs between 1Vs by the determination, for example, detection of the fewest number of Hs is carried out. As a result of the detection, computation of a black signal insertion timing is made based on the fewest number of Hs from among the H numbers among 3Vs, thereby setting a black insertion ratio in such a changed state.

The numbers of Hs in 3Vs, as shown in (j) of FIG. 5, change until a V7 period in which all the numbers are detected to be 525 has been established. Thus, which the number of Hs is to be used depends on the specification. However, when the V7 period is established, an essential stable operating state is set. However, even before this stable operating state is reached, it becomes possible to set the best black insertion ratio from among the insertion ratios in the case of the present embodiment.

In setting the black insertion ratio, a description is given with respect to a case of setting the minimum number of Hs in 1V. A similar advantageous effect can be attained by using an average value of these three numbers of Hs or the maximum number of Hs. If the average value is used, a good black insertion ratio can be set without a great change.

In this case as well, it is possible to configure setting of the black insertion ratio so as to be freely controlled from the outside.

Such a flat display device is used as a display for use in image display. When the display device is used, a change occurs with an operating condition in the external environment conditions. In these environment states as well, it is desirable to change the black insertion ratio in order to ensure an optimal operating condition.

Therefore, a temperature sensor is allocated at the periphery of a flat display panel on which a temperature of the flat display panel can be best sensed. The ambient temperature is detected by means of the temperature sensor; a register incorporated in a controller is converted based on the thus detected temperature; and a black insertion ratio determining section is controlled, thereby making it possible to change a timing of the black insertion ratio according to the temperature. This temperature sensor may be used for the purpose of measuring the temperature of the flat display panel itself or may be used for the purpose of measuring the ambient temperature under the external environment.

Figure 6:
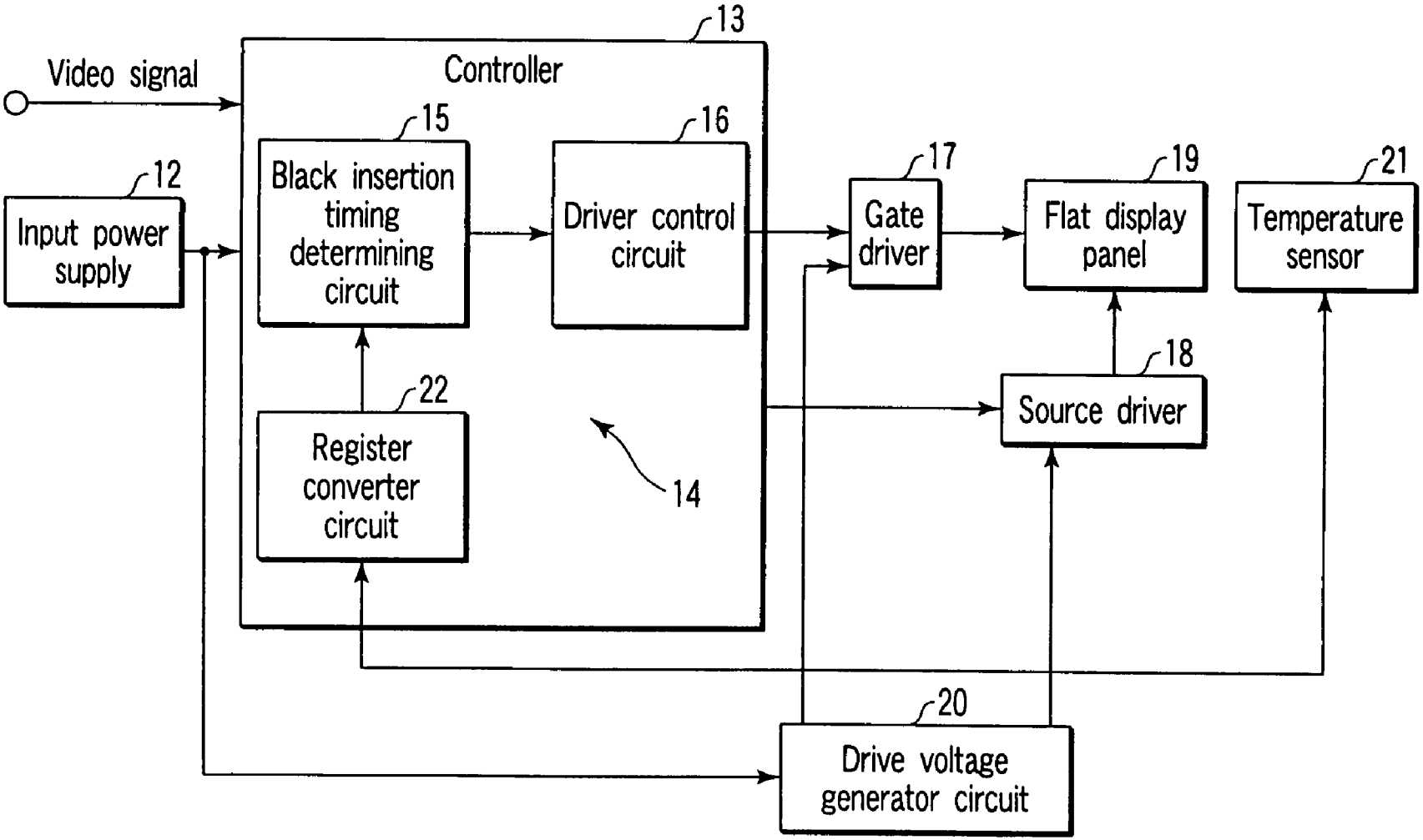
FIG. 6 is a diagram showing a modification of the circuit configuration of the flat display device shown in FIG. 1.
Figure 7:
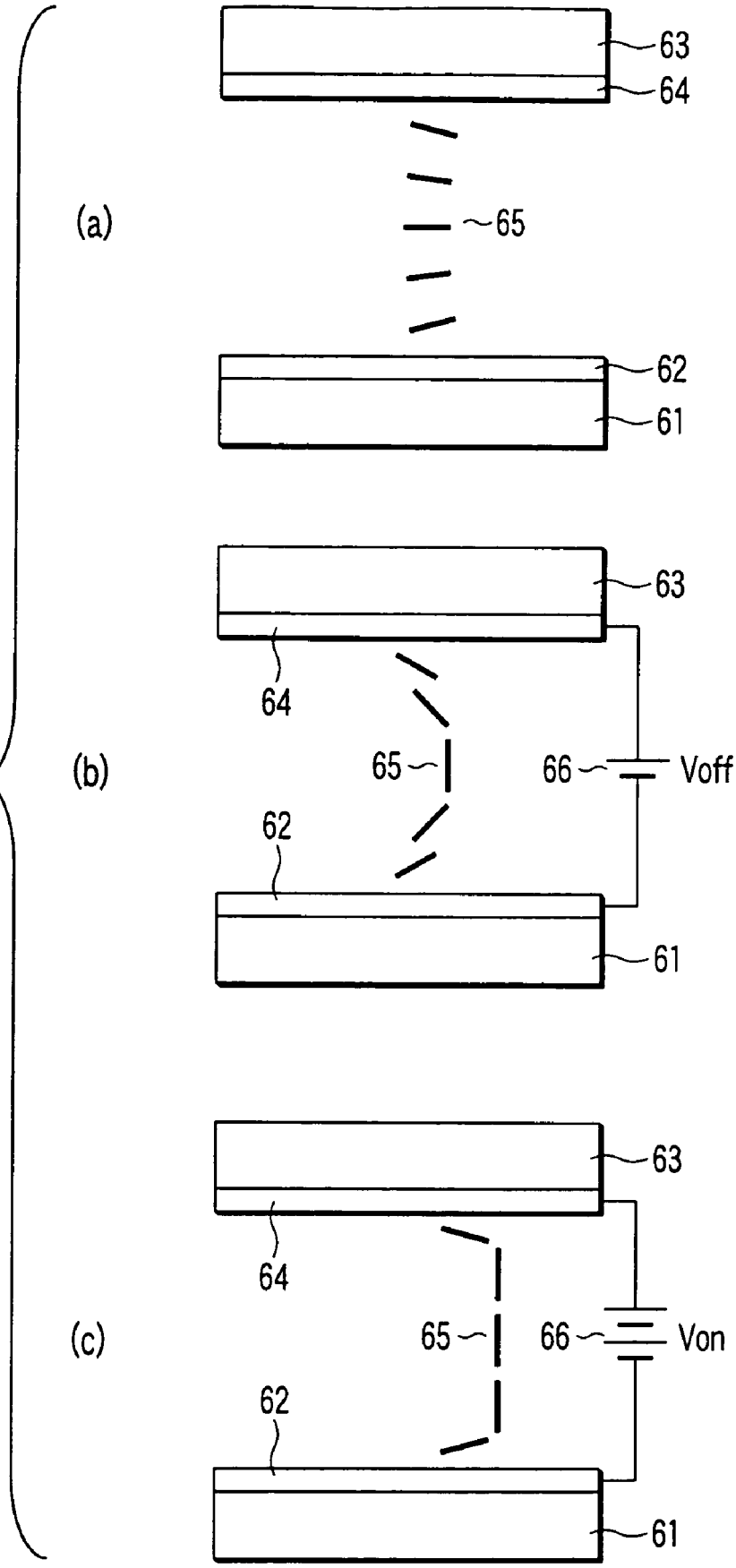
FIG. 7 is a diagram for explaining a display principle of a conventional OCB-type liquid crystal display panel.
Figure 8:
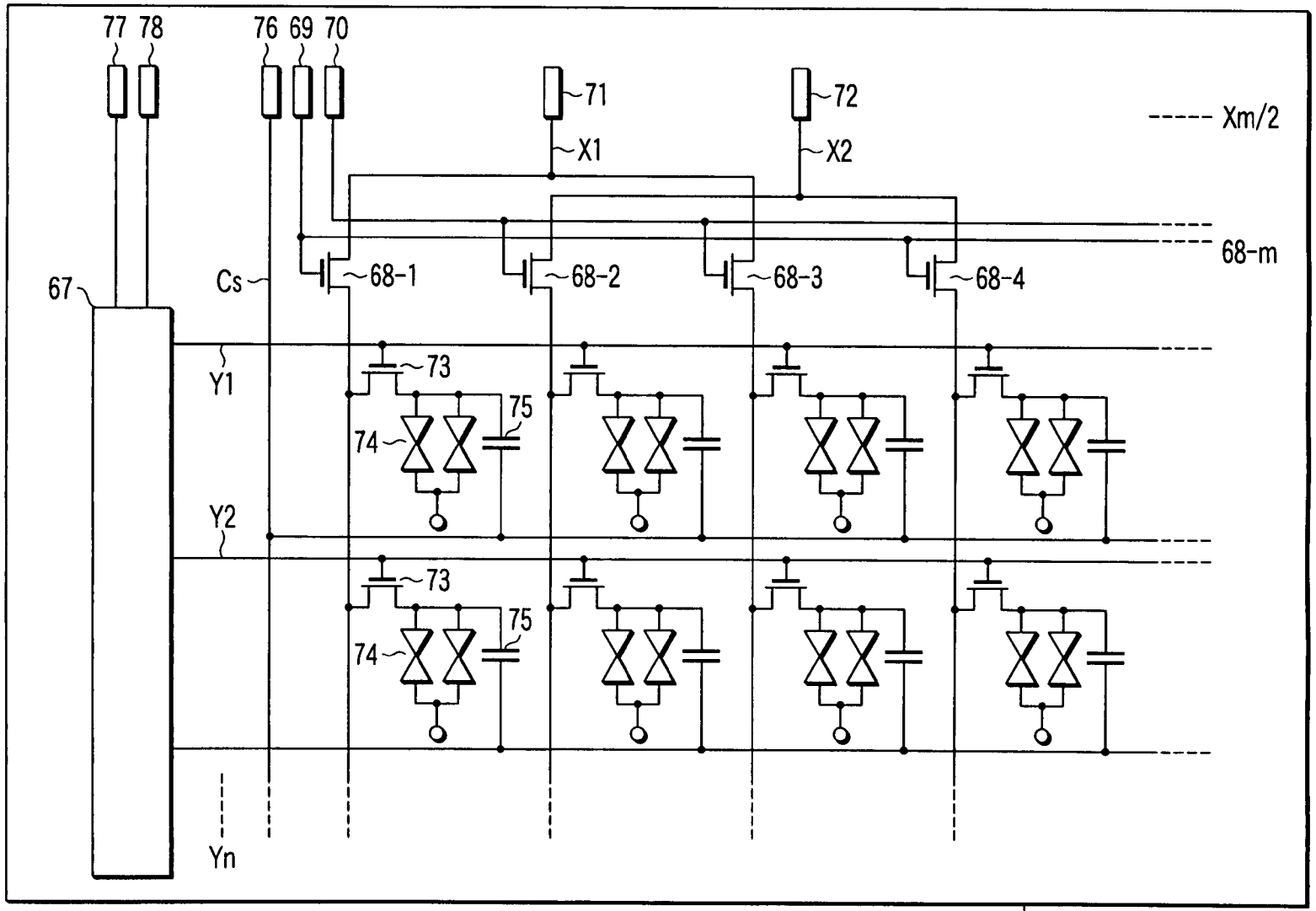
FIG. 8 is a diagram showing the circuit configuration of the liquid crystal display panel shown in FIG. 7.
Figure 10:
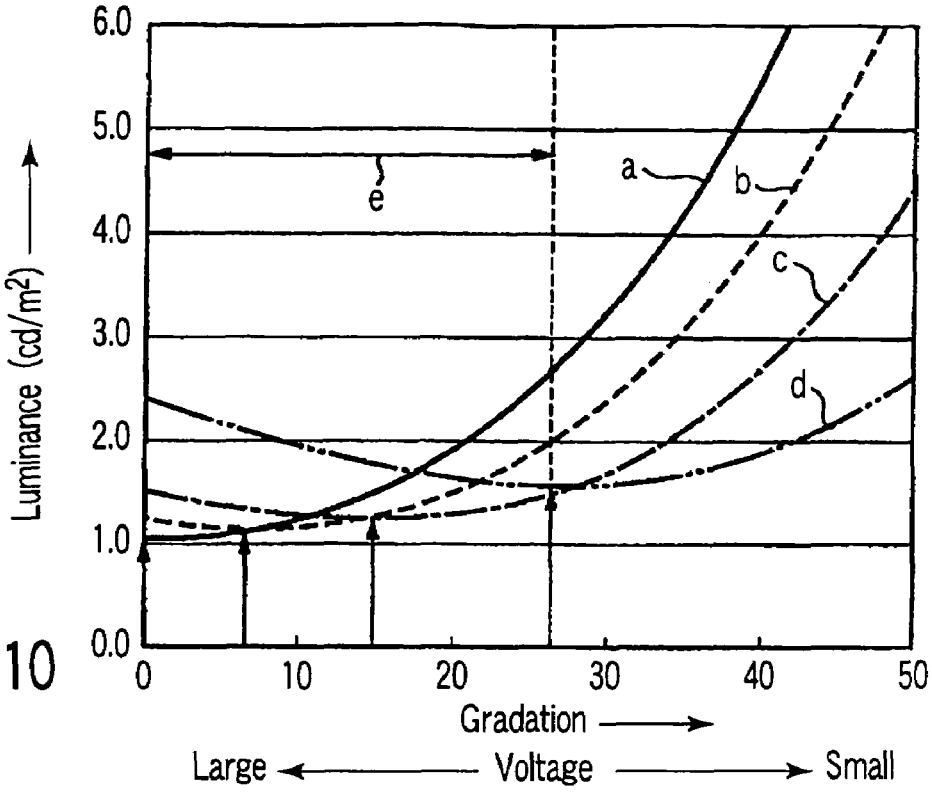
FIG. 10 is a graph showing a gamma characteristic of luminance to ambient temperature that is obtained in the liquid crystal display panel shown in FIG. 8.
Figure 11:
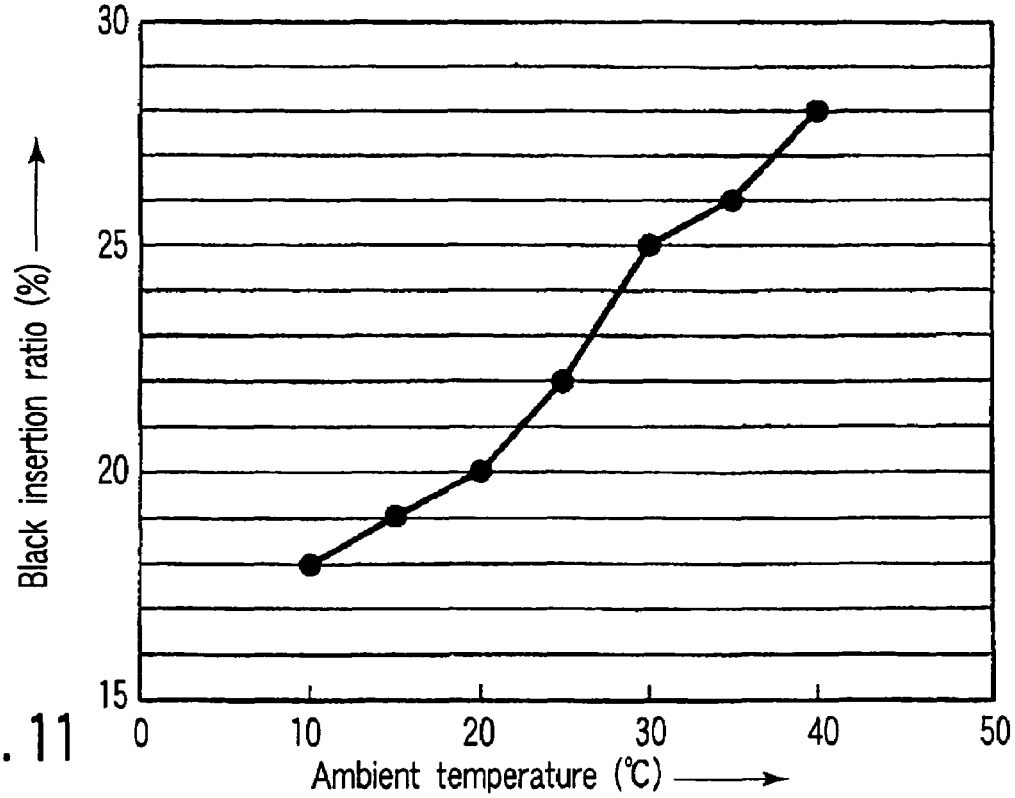
FIG. 11 is a graph showing a black insertion ratio characteristic of a black insertion ratio to ambient temperature obtained in the liquid crystal display panel shown in FIG. 8.

That is, as shown in FIG. 6, a temperature sensor 21 is allocated at the periphery of the flat display panel 19 or at a position at the periphery of the flat display panel 19 at which the temperature of the flat display panel 19 is best measured, thereby detecting the temperature of the flat display panel 19 itself or its ambient temperature. It is desirable that a thermister is used as the temperature sensor 21 in the use temperature range of 0 to 60° C. as in a television set or the like. Alternatively, it is desirable that a digital temperature sensor is used in the wide use temperature range from below 0° C. to about 80° C. as in a car navigation system or the like.

In the present embodiment, similar components shown in the embodiment described previously are denoted by the same reference symbols, and a detailed description thereof is omitted.

On the basis of the measurement temperature measured by this temperature sensor 21, the condition setting of the black insertion timing determining circuit 15 is changed by a register converter circuit 22 provided in the controller 13, and the black insertion timing is changed. For example, if 8-bit configured video signal is defined as a signal to be input to the controller 13, a digital temperature sensor is used as the temperature sensor 21. In the case where a high temperature is sensed by the digital temperature sensor, the black insertion timing determining circuit 15 is controlled to be digitally processed by the register converter circuit 22 so as to increase the black insertion ratio, so that a black display voltage is reduced, thereby making it possible to restrict the lowering of the contrast on the flat display panel 19. In this manner, a temperature change due to a change of the ambient temperature of the flat display panel 19 is detected by the temperature sensor 21, thereby making it possible to change the black insertion ratio in track with a temperature change. Thus, it is possible to set an optimal black signal insertion timing according to its use state.

While the above embodiment has described a case in which an OCB-type liquid crystal display panel is used as the flat display panel 19, an electroluminescent (EL) display panel can also be used. Further, in the case where the luminance of a backlight is changed according to the contents of a moving image displayed on the flat display panel 19 as well, it is possible to provide a configuration so as to change the luminance together with the black insertion ratio. Of course, various applications or modifications can occur within the range without departing from the spirit of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A flat display panel driving method for driving a flat display panel which includes a matrix array of pixels to display an image, comprising the steps of:

receiving a video signal supplied externally along with a vertical sync signal defining a vertical scanning period and horizontal sync signals each defining a horizontal scanning period in the vertical scanning period;

writing said video signal and a non-video signal into each row of pixels in the vertical scanning period; and controlling a write timing of said non-video signal to synchronize with a write timing of said video signal;

wherein said control step includes counting the number of horizontal sync signals supplied within each of vertical scanning periods defined by a predetermined number of successive vertical sync signals, storing counts of the number obtained for the successive vertical sync signals, comparing the counts, and causing the write timing of said non-video signal to depend on a result of the comparison, and said control step further includes determining the number of horizontal sync signals supplied within the vertical scanning period based on the result of comparison and obtaining a video signal holding period which is represented by a formula: number of horizontal sync signals supplied within vertical scanning period×(100 non-video signal insertion ratio)/100, and then determining a timing that is delayed by said video signal holding period from the write timing of said video signal, as the write timing of said non-video signal.

2. The method according to claim 1, wherein said result of comparison is obtained as an average value of the counts.

3. The method according to claim 1, wherein said control step includes measuring a temperature of said flat display panel or ambient temperature of said flat display panel, and causing a result of measurement to be reflected in the write timing of said non-video signal.

4. A flat display device comprising:

a matrix array of pixels that displays an image;

a controller that receives a video signal supplied externally along with a vertical sync signal defining a vertical scanning period and horizontal sync signals each defining a horizontal scanning period in the vertical scanning period;

a driver circuit that is controlled by said controller and writes said video signal and a non-video signal into each row of pixels in the vertical scanning period; and an insertion timing setting section that controls a write timing of said non-video signal to synchronize with a write timing of said video signal;

wherein said insertion timing setting section is configured to count the number of horizontal sync signals supplied within each of vertical scanning periods defined by a predetermined number of successive vertical sync signals, store counts of the number obtained for the successive vertical sync signals, compare the counts, and cause the write timing of said non-video signal to depend on a result of the comparison, and said insertion timing setting section is further configured to determine the number of horizontal sync signals supplied within the vertical scanning period, based on the result of the comparison and obtain a video signal holding period which is represented by a formula: number of horizontal sync signals supplied within vertical scanning period×(100 non-video signal insertion ratio)/100, and then determine a timing that is delayed by said video signal holding period from the write timing of said video signal, as the write timing of said non-video signal.

5. The device according to claim 4, wherein said insertion timing setting section is configured to measure a temperature of said flat display panel or ambient temperature of said flat display panel, and cause a result of measurement to be reflected in the write timing of said non-video signal.

6. A flat display panel driving method for driving a flat display panel which includes a matrix array of pixels to display an image, comprising the steps of:

receiving a video signal supplied externally along with a horizontal sync signal defining a horizontal scanning period and a vertical sync signal defining a vertical scanning period;

writing said video signal and a non-video signal into each row of pixels in each vertical scanning period; and controlling a write timing of said non-video signal to synchronize with a write timing of said video signal;

wherein said control step includes counting the number of horizontal snyc signals supplied within the vertical scanning period defined by each vertical sync signal, and determining the write timing of said non-video signal based on a result of counting, and wherein said control step includes obtaining a video signal holding period which is represented by a formula: number of horizontal sync signals supplied within vertical scanning period×(100−non-video signal insertion ratio)/100, and then determining a timing that is delayed by said video signal holding period from the write timing of said video signal, as the write timing of said non-video signal.

7. A flat display device comprising:

a matrix array of pixels that displays an image;

a controller that receives a video signal supplied externally along with a horizontal sync signal defining a horizontal scanning period and a vertical sync signal defining a vertical scanning period;

a driver circuit that is controlled by said controller and writes said video signal and a non-video signal to each row of pixels in each vertical scanning period; and an insertion timing setting section that controls a write timing of said non-video signal to synchronize with a write timing of said video signal;

wherein said insertion timing setting section is configured to count the number of horizontal sync signals supplied within the vertical scanning period defined by each vertical sync signal, and then determine the write timing of said non-video signal based on a result of counting, and wherein said insertion timing setting section is configured to obtain a video signal holding period which is represented by a formula: number of horizontal sync signals supplied within vertical scanning period×(100−non-video signal insertion ratio)/100, and then determine a timing that is delayed by said video signal holding period from the write timing of said video signal, as the write timing of said non-video signal.

* * * * *